US007302976B1

(12) United States Patent
Bultman

(10) Patent No.: US 7,302,976 B1
(45) Date of Patent: Dec. 4, 2007

(54) DRAIN FUNNEL

(76) Inventor: Joel S. Bultman, 12217 Cartway Curve, Eden Prairie, MN (US) 55347

( * ) Notice: Subject to any disclaimer, the term of this patent is extended or adjusted under 35 U.S.C. 154(b) by 0 days.

(21) Appl. No.: 11/213,403

(22) Filed: Aug. 29, 2005

(51) Int. Cl.
*B65B 1/04* (2006.01)

(52) U.S. Cl. ..... 141/364; 141/367

(58) Field of Classification Search ..... 141/363–375, 141/319, 331, 383, 386; 222/563, 478, 566; 215/355
See application file for complete search history.

(56) References Cited

U.S. PATENT DOCUMENTS 3,966,099 A * 6/1976 Sanford et al. ..... 222/478
5,918,650 A * 7/1999 Borden ..... 141/383
6,182,720 B1 * 2/2001 Barnoski et al. ..... 141/375
6,260,590 B1 * 7/2001 Ziegmann ..... 141/332

* cited by examiner

*Primary Examiner*—Steven O. Douglas

(57) ABSTRACT

An adapter for aligning the openings of and connecting two bottles has a channel through which fluid material can be conveyed between the bottles using gravity. The adapter is a two-piece molded plastic device forming a generally cylindrical body which can be separated for cleaning. Flanges surrounding top and bottom tapered portions of the body function to grip and stabilize the connected bottles during the transfer procedure.

9 Claims, 4 Drawing Sheets

DRAIN FUNNEL

FIELD OF THE INVENTION

The invention relates to the field of container accessories to assist material and fluid transfer between containers. In particular, the invention relates to adapters connecting the containers to facilitate the emptying of the contents of one container into another container.

BACKGROUND OF THE INVENTION

It is prudent to conserve and prevent waste of consumable substances and materials. Transfer of gravity flow fluids and semi-fluids having relatively slow flow velocities, such as pastes, thick liquid suspensions, soups and purees, is time consuming and burdensome. Convenience dictates discarding of bottles and containers despite having residual amounts of consumable materials contained therein without first completely removing the contents of the container. Attempts have been made to effectuate the transfer and emptying of the contents of one container into a second container with limited success.

SUMMARY OF THE INVENTION

The adapter of the invention is used to funnel and transfer relatively slow moving materials and gravity flow liquids between containers, such as food puree containers and the like.

The adapter has a generally cylindrical body having a top section releasably attached to a bottom section. The body has an internal passage which is open to the top and bottom of the body. The top section of the body has a tapered upper portion adapted to fit into the neck of a substantially empty container desired to be drained. The top section of the body has a plurality of openings in communication with top of the passage to allow material to move from the container into the passage. Outwardly and upwardly extending concave curved flanges located adjacent the bottom of each opening collect and direct material through the openings and into the passage. The flanges are longitudinally spaced annular members having successively increasing diameters to fit different sized container openings. The bottom section of the body has a plurality of openings in communication with the bottom of the passage to allow material to flow out of the passage and permit air to vent from the container receiving material from the first container.

DESCRIPTION OF PREFERRED EMBODIMENT

Figure 1:
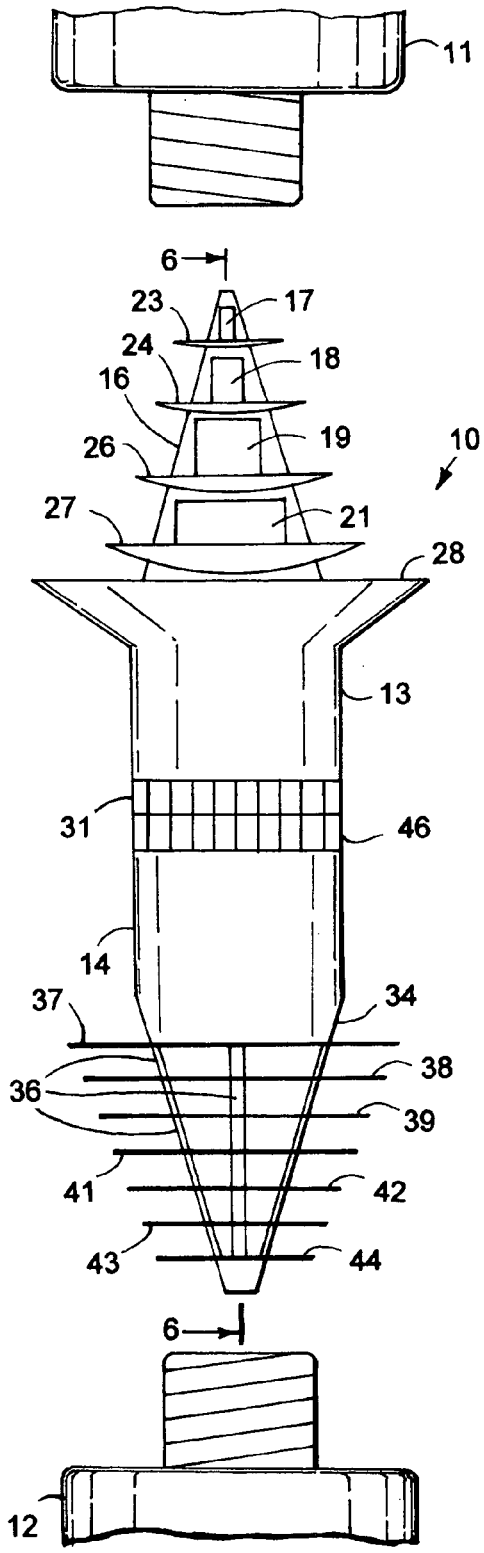
FIG. 1 is a front elevational view of the adapter of the invention aligned with the openings of two bottles.

Referring to FIGS. 1 to 6, there is shown an adapter or drain funnel 10 of the invention useable to drain and transfer liquids, suspensions, and semi-liquid materials from one container 11 to another container 12 with minimal effort and supervision. Adapter 10 is a two-piece generally cylindrical shaped plastic molded member having a top body member 12 threadably attached to a bottom body member 14. The outer surfaces of end 31 of body member 13 and end 46 of body member 14 are knurled to aid in gripping members 13 and 14 when separating and/or joining member 13 with body member 14. Other materials can be used to make adapter 10. Adapter 10 can have a one-piece body construction.

Figure 6:
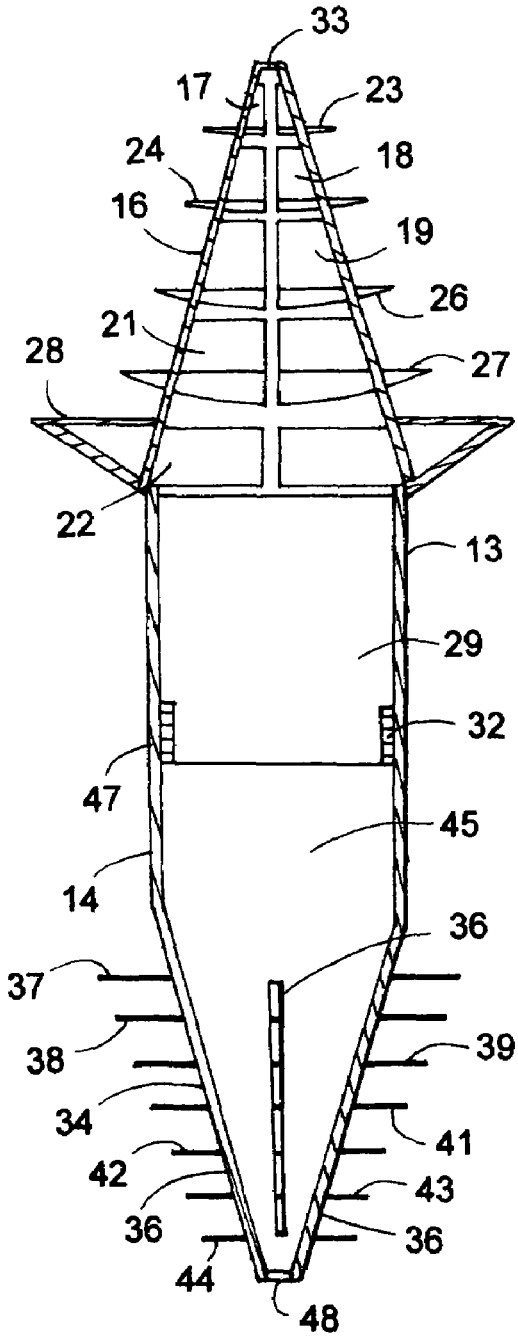
FIG. 6 is a sectional view taken along line 6-6 of FIG. 1.

Top member 13 has a generally cylindrical shape having an upwardly tapered upper end 16 surrounding a passage 29 open to the ends of top member 13. The top of upper end 16 has an opening 33 to permit material to drain directly into passage 29 from container 11. Opening 33 also allows air to enter container 11 to replace the material drained from container 11. Upper end 16 has a plurality of generally rectangular side openings or holes 17, 18, 19, 21 and 22 to allow material to enter passage 29. Holes 17, 18, 19, 21 and 22 can have other shapes and patterns such as circle, oval and square shapes and mesh and gird patterns. The size of holes 17-19 and 21-22 increase from the top of upper end 16 to the bottom thereof as seen in FIG. 6.

Figure 2:
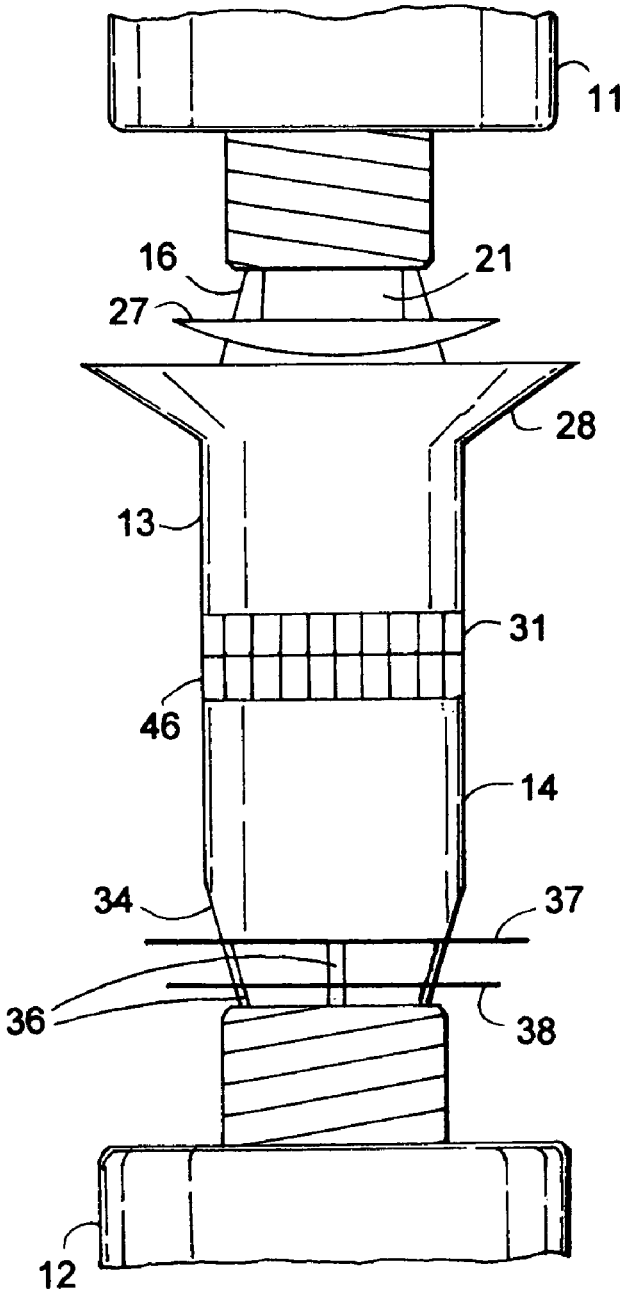
FIG. 2 is a front elevational view of the adapter of FIG. 1 inserted into the aligned openings of the bottles.
Figure 3:
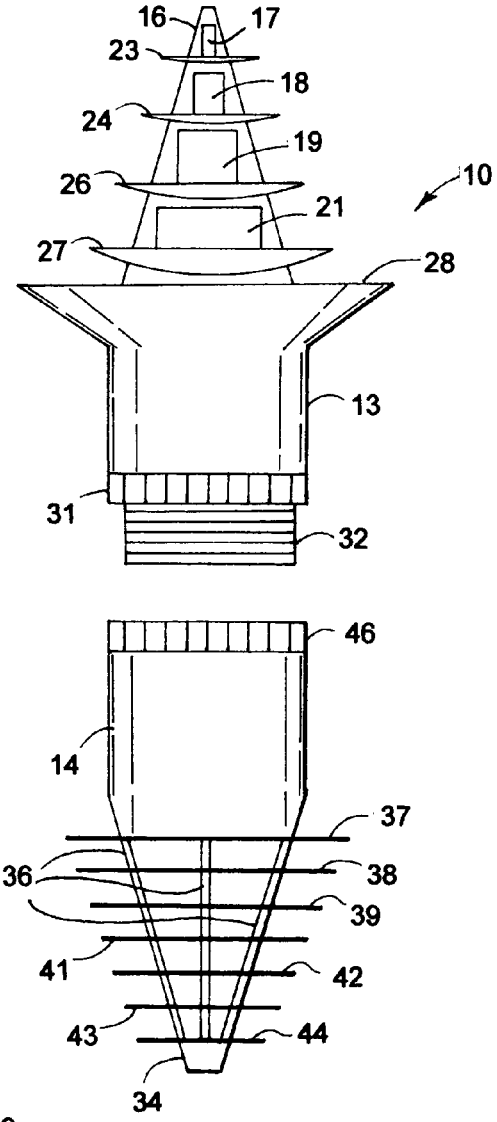
FIG. 3 is a front elevational view of the adapter of FIG. 1 with the body members of the adapter separated.
Figure 4:
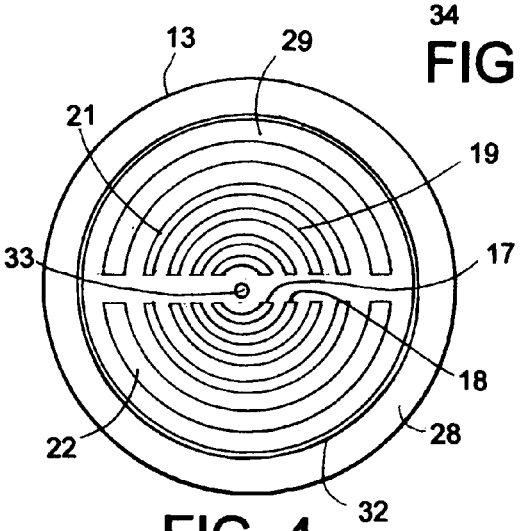
FIG. 4 is a bottom plan view of the top body member of the adapter of FIG. 1.
Figure 5:
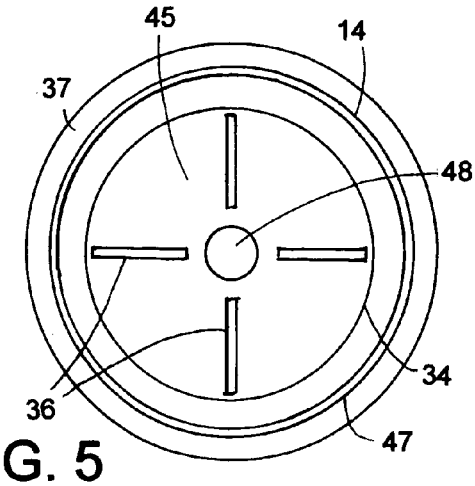
FIG. 5 is a top plan view of the bottom body member of the adapter of FIG. 1.

A plurality of saucer shaped concave curved annular flanges 23, 24, 26 and 27 extending outwardly and slightly upwardly from the outer surface of upper end 16 adjacent the bottom of openings 17, 18, 19 and 21 direct material toward openings 17-19 and 21 whereby the material enters passage 29 through the openings. Flanges 23, 24, 26 and 27 are longitudinally spaced and increase in diameter from the top of upper end 16 to the bottom thereof to accommodate containers having different sized and/or shaped openings. Flanges 23-24 and 26-27 are preferably made of elastic rubber or semi-flexible plastic material that engages and conforms to the shape of the inside surface of container 11 to stabilize container 11 when inverted and connected to container 12 as seen in FIG. 2.

An outwardly extending annular shoulder 28 located at the bottom of upper end 16 has a downwardly and inwardly inclined bottom wall. The diameter of shoulder 28 is greater that the diameter of the neck opening of container 11 whereby liquid flowing out of container 11 is collected and directed through opening 22 in upper portion 16 and into passage 29.

Bottom member 14 has a generally cylindrical shape having a downwardly tapered lower end 34 surrounding a passage 45 aligned with passage 29 in top member 13. A plurality of elongated linear openings or slots 36 radially spaced on lower end 34 are open to passage 45 to allowing material to move out of passage 45 through slots 36 and into container 12. As material flows into container 12 air is vented out of container 12 through the top of slots 36.

A plurality of annular flanges 37, 38, 39, 41, 42, 43 and 44 extend outwardly from the lower end 34 of body member 14. Flanges 37-39 and 41-44 are longitudinally spaced and decrease in diameter from the top of lower end 34 to the bottom thereof to accommodate containers having different sized and/or shaped openings. Preferably flanges 37-39 and 41-44 are made of elastic rubber or flexible plastic to facilitate the gripping of container 12 and stabilization of adapter 10 and container 11. Depending on the size and shape of the container one or more flanges 37-39 and 41-44 engage and grip the inside surface of the neck of the container and stabilizes adapter 10 on the container. The bottom of lower end 34 has an opening 48 to permit material to flow directly from passage 45 into container 12.

In use, when container 11 is almost empty, the tapered lower end 34 of body member 14 is inserted into the neck opening of container 12 to be filled. Lower end 34 extends into the opening of container 12 as shown in FIG. 2. Flanges 39, 41 and 42 engage the inside surface of the neck of container 12 to stabilize adapter 10 on container 12. Container 11 is then inverted and placed on the tapered upper end 16 of body member 13. Upper end 16 extends into the neck opening of container 11. Flanges 24 and 26 engage the inside surface of the neck of container 11 to stabilize container 11 on adapter 10 and container 12. Material contained within container 11 gravitates out of container 11 through adapter 10 and into container 12 with minimal effort and supervision. Material moves through holes 17, 18, 19, 21 and/or 22 in upper end 16 and into passage 29. Flanges 23, 24, 26 and 27 collect and direct material into holes 17, 18, 19 and 21. Annular shoulder 28 catches and directs any material dripping from container 11 into hole 22. From passage 29 material enters passage 45 and flows out of body member 14 through the bottom of slots 36 and exit hole 48 in the bottom of lower end 34. Air is vented from container 12 through passage 46 and the top of slots 36 as material moves into container 12 from container 11 to ensure continuous flow of material. The longitudinal spacing and varying diameters of flanges 23-24 and 26-27 on upper end 16 and flanges 37-39 and 41-44 on lower end 34 are adaptable to different sized openings of containers requiring material transfer.

There has been shown and described an embodiment of the adapter of the invention. Changes in the materials, structures, and arrangement of structures may be made by persons skilled in the art without departing from the invention.

The invention claimed is:

1. A drain funnel for transferring material from a first container to a second container, each container having a neck surrounding an opening, comprising: a body having a top section, bottom section and a passage extending through the top and bottom sections, the top section being releasably attached to the bottom section, the top section adapted to be inserted into the opening of the first container and the bottom section adapted to be inserted into the opening of the second container to connect the first and second containers and drain the material from the first container into the second container, the top section having a plurality of longitudinally spaced openings in communication with the passage, the bottom section having a plurality of radially spaced slots in communication with the passage.

2. The drain funnel of claim 1 wherein: the bottom section has flange means engageable with the inside of the neck of the second container.

3. The drain funnel of claim 1 wherein: the top section has means for collecting material and directing the material into the passage.

4. The drain funnel of claim 1 wherein: the top section has an outwardly and upwardly extending annular shoulder having a downwardly and inwardly inclined bottom wall, the shoulder having a diameter greater than the diameter of the neck of the first container.

5. An adapter for connecting an inverted first container to a second container to transfer material from the first container to the second container comprising: a body having a first member releasably attached to a second member surrounding an internal passage, the passage open to the top of the first member and the bottom of the second member, the first member having an upper portion adapted to fit into the neck of the first container, the upper portion having a plurality of longitudinally spaced openings in communication with the passage to allow material contained in the first container to move into the passage, the first member having a plurality of flange members extending outwardly from the upper portion of the first member, at least one of the flange members being engageable with the inside of the neck of the first container, each flange member being located adjacent the bottom of one of the openings in the upper portion of the first member, the second member having a lower portion adapted to fit into the neck of the second container, the lower portion having at least one opening in communication with the passage to allow material located in the passage to move out of the passage and into the second container.

6. The adapter of claim 5 wherein: each flange member is a semi-rigid annular concave curved longitudinally spaced member, the flange members having successively increasing diameters.

7. The adapter of claim 5 wherein: the second member has a plurality of annular second flange members extending outwardly from the lower portion of the second member, at least one of the second flange members being engageable with the inside of the neck of the second container.

8. The adapter of claim 7 wherein: each second flange member is a semi-rigid longitudinally spaced annular member, the second flange members having successively decreasing diameters.

9. The adapter of claim 5 wherein: the first member has an outwardly and upwardly extending annular shoulder a downwardly and inwardly inclined bottom wall, the shoulder having a diameter greater than the diameter of the neck of the first container.

* * * * *